US009420921B1

(12) United States Patent
Mercado

(10) Patent No.: US 9,420,921 B1
(45) Date of Patent: Aug. 23, 2016

(54) BATH SCRUBBING SYSTEM

(71) Applicant: George Mercado, Long Beach, CA (US)

(72) Inventor: George Mercado, Long Beach, CA (US)

( * ) Notice: Subject to any disclaimer, the term of this patent is extended or adjusted under 35 U.S.C. 154(b) by 233 days.

(21) Appl. No.: 14/060,939

(22) Filed: Oct. 23, 2013

(51) Int. Cl.
*A47K 7/02* (2006.01)

(52) U.S. Cl.
CPC ..... *A47K 7/024* (2013.01)

(58) Field of Classification Search
USPC ..... 4/606
See application file for complete search history.

(56) References Cited

U.S. PATENT DOCUMENTS 5,311,635 A 5/1994 Moore
5,628,083 A * 5/1997 Hayes ..... 15/244.3
5,822,824 A 10/1998 Dion
D400,658 S 11/1998 Mejia, Sr.
6,526,618 B1 3/2003 Bolton
7,434,287 B1 10/2008 Borges
7,467,438 B2 12/2008 Ryman
2006/0225239 A1* 10/2006 Placencia ..... A47K 7/024 15/244.3
2007/0022527 A1* 2/2007 Russo et al. ..... 4/606

OTHER PUBLICATIONS

"Compac Hands Free Bare Back Scrubber", Compac, www.amazon.com, Website, Accessed on Jun. 5, 2013.

* cited by examiner

*Primary Examiner* — Lauren Crane

(57) ABSTRACT

A bath scrubbing system for effectively scrubbing hard to reach areas on a body of a user features a shower having a vertical wall. The system features a planar base located on the vertical wall via a suction attaching means. The system features a sponge component, a brush component, and a luffa component each positioned on the base via a first hook and loop component and mated second hook and loop components. The sponge component, the brush component and the luffa component are designed to all fit on the base simultaneously or individually in an adjustable manner. The system features a removable lid designed to fit over and fully enclose the sponge component, the brush component and the luffa component when located on the base.

1 Claim, 3 Drawing Sheets

(ISO View)

(Bottom View)

(Exploded View)

(Side View)

(Front View)

BATH SCRUBBING SYSTEM

FIELD OF THE INVENTION

The present invention relates to shower accessories, or more specifically, shower accessories to aid in scrubbing a person's body in hard to reach places.

BACKGROUND OF THE INVENTION

The desire to use a device to scrub one's back has existed as long as mankind has attempted to bathe. Over the years, various methods have been tried, such as using a rag stretched behind the back or using a scrubber on an end of a pole. The present invention features a bath scrubbing system for effectively scrubbing hard to reach areas on a body of a user using a base with an attachment on a vertical wall of a shower.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a bath scrubbing system for effectively scrubbing hard to reach areas on a body of a user. In some embodiments, the system comprises a shower having a vertical wall. In some embodiments, the system features a planar base having a first hook and loop component located on a front surface thereon and a suction attaching means located on a rear surface. In some embodiments, the base is located on the vertical wall via the suction attaching means.

In some embodiments, the system features a sponge component having a sponge located on a sponge front surface and a second hook and loop component located on a sponge rear surface. In some embodiments, the system features a brush component having a brush located on a brush front surface and a second hook and loop component located on a brush rear surface. In some embodiments, the system features a luffa component having a loofa located on a luffa front surface and a second hook and loop component located on a luffa rear surface.

In some embodiments, the sponge component, the brush component and the luffa component are all positioned on the base via the first hook and loop component and the mated second hook and loop components. In some embodiments, the sponge component, the brush component and the luffa component are designed to all fit on the base simultaneously or individually in an adjustable manner. In some embodiments, the system comprises a removable lid designed to fit over and fully enclose the sponge component, the brush component and the luffa component when located on the base.

In some embodiments, for use, one or more of the sponge component, the brush component or the luffa component is located on the base via the first hook and loop component and the mated second hook and loop components. In some embodiments, a user positions his body against the system and moves around for scrubbing.

DESCRIPTION OF PREFERRED EMBODIMENTS

Figure 1:
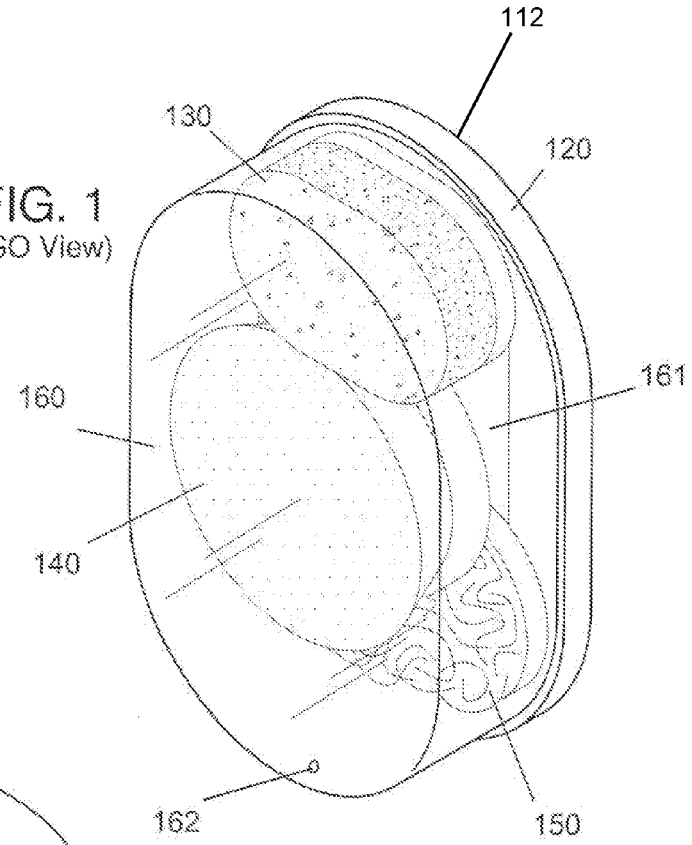
FIG. 1 shows a perspective view of the base, the sponge component, the brush component, the luffa component and the lid of the present invention.
Figure 2:
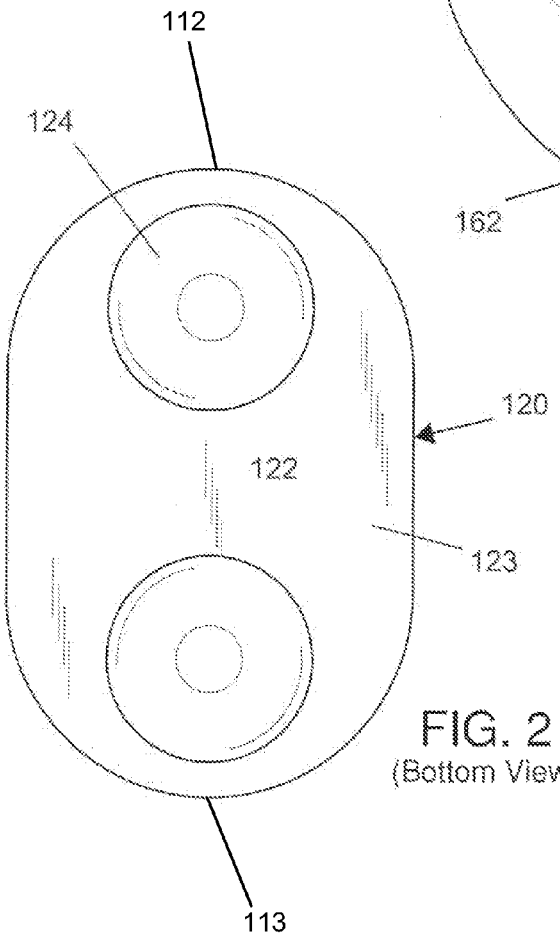
FIG. 2 shows a rear view of the base of the present invention.
Figure 3:
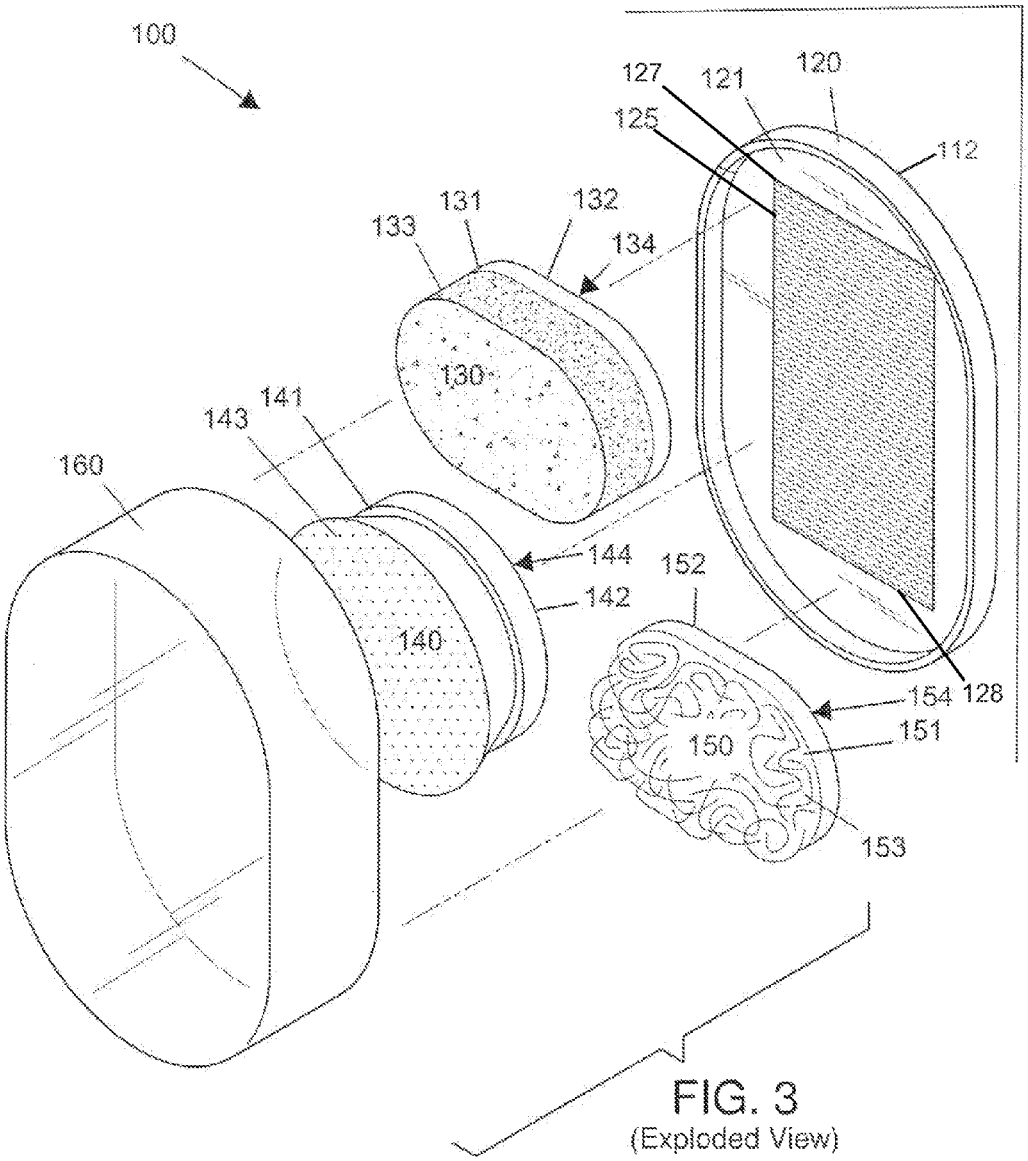
FIG. 3 shows an exploded view of the base, the sponge component, the brush component, the luffa component and the lid of the present invention.
Figure 4:
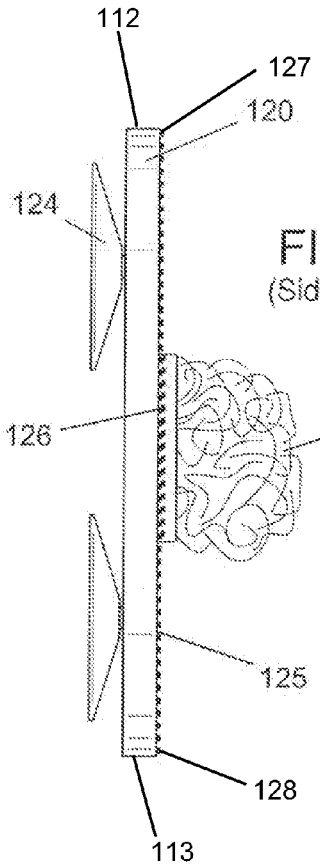
FIG. 4 shows a side view of the base of the present invention.
Figure 5:
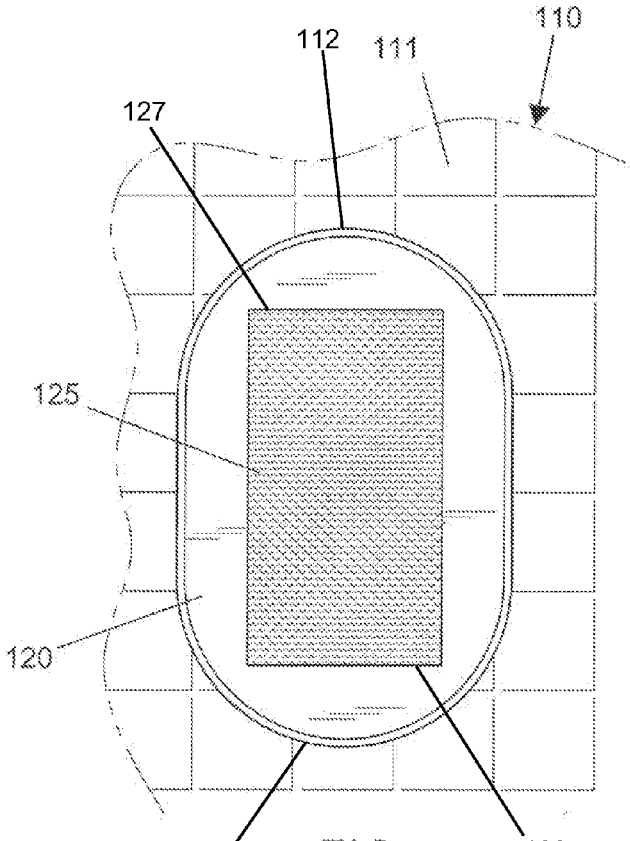
FIG. 5 shows a front view of the base of the present invention.

Following is a list of elements corresponding to a particular element referred to herein:

100 Bath scrubbing system
110 Shower
111 Vertical wall
120 Base
121 Base front surface
122 Base rear surface
123 Base surface area
124 Suction attaching means
125 First hook and loop component
125 Second hook and loop component
130 Sponge component
131 Sponge front surface
132 Sponge rear surface
133 Sponge
134 Sponge component rear surface area
140 Brush component
141 Brush front surface
142 Brush rear surface
143 Brush bristles
144 Brush component rear surface area
150 Luffa component
151 Luffa front surface
152 Luffa rear surface
153 Luffa
154 Luffa component rear surface area
160 Lid
161 Lid side wall
162 Drain hole Referring now to FIG. 1-5, the present invention features a bath scrubbing system (100) for effectively scrubbing hard to reach places on a body of a user. In some embodiments, the system (100) comprises a shower (110) having a vertical wall (111) located therein.

In some embodiments, the system (100) comprises a planar base (120) having a first hook and loop component (125) located on a base front surface (121) thereon and a suction attaching means (124) located on a base rear surface (122) thereon. In some embodiments, the planar base (120) comprises a base surface area (123). In some embodiments, the base surface area (123) is computed by multiplying a base width by a base height. In some embodiments, the planar base (120) having a base first end (112), a base second end (113) on an opposite end of the base first end (112). In some embodiments, the first hook and loop component (125) having a first hook and loop component first end (127) and a first hook and loop component second end (128); wherein the first hook and loop component first end (127) is disposed proximal to the base first end (112) and the first hook and loop component second end (128) is disposed proximal to the base second end (113).

In some embodiments, the system (100) comprises a sponge component (130) having a sponge (133) located on a sponge front surface (131) and a second hook and loop component (126) located on a sponge rear surface (132).

In some embodiments, the system (100) comprises a brush component (140) having brush bristles (143) located on a brush front surface (141) and a second hook and loop component (126) located on a brush rear surface (142).

In some embodiments, the system (100) comprises a luffa component (150) having a loofa located on a luffa front surface (151) and a second hook and loop component (126) located on a luffa rear surface (152).

In some embodiments, the sponge component (130), the brush component (140), and the luffa component (150) are distinct and separate units with separate functions. In some embodiments, it is critical in the invention to combine functionality of each of the three units.

In some embodiments, the sponge component (130), the brush component (140) and the luffa component (150) are all located on the base (120) via the first hook and loop component (125) and the mated second hook and loop components (126). In some embodiments, the sponge component (130), the brush component (140) and the luffa component (150) are designed to each fit on the base (120) simultaneously. In some embodiments, the sponge component (130), the brush component (140) and the luffa component (150) are each designed to fit on the base (120) individually in an adjustable manner with respect to a height and latitude via the first hook and loop component (125) and the mated second hook and loop components (126). In some embodiments, a sponge component rear surface area (134), a brush component rear surface area (144) and a luffa component rear surface area (154) combine to be smaller than the base surface area (123).

In some embodiments, the system (100) comprises a lid (160) having a lid side wall (161) located thereon. In some embodiments, the lid (160) is removably located on the base front surface (121). In some embodiments, the lid (160) is designed to fit over and fully enclose the sponge component (130), the brush component (140) and the luffa component (150) when each or all are located on the base (120).

In some embodiments, for use one or more of the sponge component (130), the brush component (140) or the luffa component (150) is located on the base (120) via the first hook and loop component (125) and the mated second hook and loop components (126). In some embodiments, a user positions his body against the system (100) and moves around for scrubbing.

In some embodiments, the lid (160) is transparent and is constructed from a transparent material.

In some embodiments, a drain hole (162) is located in the lid (160) for allowing drainage of the sponge component (130), the brush component (140) or the luffa component (150) when positioned on the base (120) for storage.

In some embodiments, a method of scrubbing when taking a shower comprises obtaining a bath scrubbing system (100) comprising a shower (110) having a vertical wall (111). In some embodiments, the method comprises obtaining a planar base (120) having a first hook and loop component (125) located on a base front surface (121) thereon and a suction attaching means (124) located on a base rear surface (122) thereon. In some embodiments, the planar base (120) comprises a base surface area (123). In some embodiments, the method comprises obtaining a sponge component (130) having a sponge (133) located on a sponge front surface (131) and a second hook and loop component (126) located on a sponge rear surface (132). In some embodiments, the method comprises obtaining a brush component (140) having a brush located on a brush front surface (141) and a second hook and loop component (126) located on a brush rear surface (142). In some embodiments, the method comprises obtaining a luffa component (150) having a loofa located on a luffa front surface (151) and a second hook and loop component (126) located on a luffa rear surface (152). In some embodiments, the sponge component (130), the brush component (140) and the luffa component (150) are all located on the base (120) via the first hook and loop component (125) and the mated second hook and loop components (126). In some embodiments, the sponge component (130), the brush component (140) and the luffa component (150) are designed to all fit on the base (120) simultaneously. In some embodiments, the sponge component (130), the brush component (140) and the luffa component (150) are each designed to fit on the base (120) individually in an adjustable manner with respect to height and latitude via the first hook and loop component (125) and the mated second hook and loop components (126). In some embodiments, a sponge component rear surface area (134), a brush component rear surface area (144) and a luffa component rear surface area (154) combine to be smaller than the base surface area (123). In some embodiments, the method comprises obtaining a lid (160) having a lid side wall (161) located thereon. In some embodiments, the lid (160) is removable located on the base front surface (121). In some embodiments, the lid (160) is designed to fit over and fully enclose the sponge component (130), the brush component (140) and the luffa component (150) when located on the base (120).

In some embodiments, the method comprises placing the base (120) on the vertical wall (111) via the suction attaching means (124).

In some embodiments, the method comprises removing the lid (160) from the base (120).

In some embodiments, the method comprises positioning one or more of the sponge component (130), the brush component (140) or the luffa component (150) on the base (120).

In some embodiments, the method comprises placing the body of the user against the sponge component (130), the brush component (140) and/or the luffa component (150) and moving around for scrubbing the body. In some embodiments, any or all of the sponge component (130), the brush component (140) and/or the luffa component (150) are used for scrubbing the body.

As used herein, the term "about" refers to plus or minus 10% of the referenced number.

The disclosures of the following U.S. Patents are incorporated in their entirety by reference herein: U.S. Pat. No. D 400,658; U.S. Pat. No. 7,467,438; U.S. Pat. No. 7,434,287; U.S. Pat. No. 6,526,618; U.S. Pat. No. 5,822,824; and U.S. Pat. No. 5,311,635.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A bath scrubbing system (100) for effectively scrubbing hard to reach places on a body of a user, wherein the system (100) consisting of:

(a) a shower (110) having a vertical wall disposed therein;

(b) an oval planar base (120) having a base first end (112), a base second end (113) on an opposite end of the base first end (112) of the oval planar base (120), a base front surface (121) and a suction attaching means (124) disposed on a base rear surface (122) thereon, wherein the oval planar base (120) consists of a base surface area (123);

(c) a first hook and loop component (125) disposed on the base front surface (121), wherein the first hook and loop component (125) is continuous, wherein the first hook and loop component (125) is disposed continuously on the base front surface (121), the first hook and loop component (125) having a first hook and loop component first end (127) and a first hook and loop component second end (128); wherein the first hook and loop component first end (127) is disposed proximal to the base first end (112) and the first hook and loop component second end (128) is disposed proximal to the base second end (113);

(d) a sponge component (130) having a sponge (133) disposed on a sponge front surface (131) and a second hook and loop component (126) disposed on a sponge rear surface (132);

(e) a brush component (140) having brush bristles (143) disposed on a brush front surface (141) and a second hook and loop component (126) disposed on a brush rear surface (142);

(f) a luffa component (150) having a luffa (153) disposed on a luffa front surface (151) and a second hook and loop component (126) disposed on a luffa rear surface (152);

wherein the sponge component (130), the brush component (140) and the luffa component (150) are all disposed on the base (120) via the first hook and loop component (125) and the mated second hook and loop components (126), wherein the sponge component (130), the brush component (140) and the luffa component (150) are designed to each fit on the base (120) simultaneously, wherein the sponge component (130), the brush component (140) and the luffa component (150) are each designed to fit on the base (120) individually in an adjustable manner with respect to a height and a latitude via the first hook and loop component (125) and the mated second hook and loop components (126); wherein the sponge component (130), the brush component (140) and the luffa component (150) are each designed to fit on the base (120) individually or simultaneously in a rotationally adjustable manner such that the sponge component (130), the brush component (140) and the luffa component (150) may be fit on the base (120) at any angle; wherein a sponge component rear surface area (134), a brush component rear surface area (144) and a luffa component rear surface area (154) combine to be smaller than the base surface area (123); and (g) an oval lid (160) having an oval lid side wall (161) disposed thereon, wherein the oval lid (160) is removably disposed on the base front surface (121), wherein the oval lid (160) is designed to fit over and fully enclose the sponge component (130), the brush component (140) and the luffa component (150) when any or all are disposed on the base (120);

wherein for use one or more of the sponge component (130), the brush component (140) or the luffa component (150) is disposed on the base (120) via the first hook and loop component (125) and the mated second hook and loop components (126), wherein a user positions his body against the system (100) and moves around for scrubbing.

* * * * *